United States Patent [19]

Tang et al.

[11] Patent Number: 4,992,359

[45] Date of Patent: Feb. 12, 1991

[54] POLYMERIC COUPLERS

[75] Inventors: Ping-Wah Tang; Philip T. S. Lau; Stanley W. Cowan, all of Rochester, N.Y.

[73] Assignee: Eastman Kodak Company, Rochester, N.Y.

[21] Appl. No.: 532,490

[22] Filed: Jun. 4, 1990

Related U.S. Application Data

[63] Continuation-in-part of Ser. No. 239,909, Sep. 1, 1988, abandoned.

[51] Int. Cl.[5] ..... G03C 7/327

[52] U.S. Cl. ..... 430/548; 430/553; 430/555; 430/557; 430/558

[58] Field of Search ..... 430/548, 381, 553, 555, 430/557, 558

[56] References Cited

U.S. PATENT DOCUMENTS

| | | | |
|---|---|---|---|
| 4,042,393 | 8/1977 | Wada et al. | 430/548 |
| 4,401,787 | 8/1983 | Chen | 430/531 |
| 4,511,647 | 4/1985 | Hirano et al. | 430/381 |
| 4,576,909 | 3/1986 | Goto et al. | 430/546 |
| 4,612,278 | 9/1986 | Lau et al. | 430/381 |
| 4,631,251 | 12/1986 | Komamura et al. | 430/548 |
| 4,762,777 | 8/1988 | Helling et al. | 430/548 |

FOREIGN PATENT DOCUMENTS 185248 7/1982 European Pat. Off. .

*Primary Examiner*—Paul R. Michl
*Assistant Examiner*—Lee C. Wright
*Attorney, Agent, or Firm*—Joshua G. Levitt

[57] ABSTRACT

Color photographic elements comprise a support, a silver halide emulsion layer and a polymeric dye-forming coupler comprising a polyester condensation polymer having a pendant coupler moiety in which the coupler is joined via its coupling position.

6 Claims, No Drawings

POLYMERIC COUPLERS

This application claims the benefit under 35 USC 120, as a continuation-in-part, of U.S. patent application Ser. No. 239,909 filed Sept. 1, 1988, now abandoned.

FIELD OF THE INVENTION

This invention relates to silver halide color photographic materials containing novel polymeric dye forming couplers. In a particular aspect it relates to such materials in which the coupler comprises a polyester condensation polymer having a pendant coupler moiety in which the coupler is joined to the polymer backbone via its coupling position.

DESCRIPTION OF THE STATE OF THE ART

It is known that color photographic images can be formed by reaction between oxidized silver halide developing agent and a dye forming coupler. For example, a coupler of the acylacetanilide or benzoylmethane type generally is used for forming a yellow dye image; a coupler of the pyrazolone, pyrazoloazole, cyanoacetophenone or indazolone type is generally used for forming a magenta dye image; and a phenolic or naphtholic coupler is generally used for forming a cyan dye image.

In many instances where dye forming couplers are employed to form an image in color photographic materials, the coupler is incorporated in the material prior to exposure. Color development leads to an image in which a dye remains in the location where it is formed. With most such materials the coupler is fixed in place as a result of bulk conferred on it by a ballast group. One such method of conferring bulk on a coupler to cause it to remain in place is to incorporate the coupler in a polymer. U.S Pat. Nos. 4,511,647; 4,576,909; 4,612,278; and 4,631,251 are typical of recent polymeric coupler patents.

Most of the polymeric couplers known in the art are addition polymers, principally those that are based on acrylates and acrylamides. While polymeric couplers of this type are effective for a number of purposes, the polymerization technique is not amenable to a great deal of control over the size and configuration of the resulting polymer.

Condensation polymers on the other hand more readily permit control over such parameters.

Further, with many polymeric couplers, the coupler moiety remains attached to the polymer backbone after dye formation and thus can influence the hue of the resulting image dye. Having the coupler moiety joined to the polymer backbone in such a way that the two are separated uPon dye formation, provides greater freedom in selecting a parent polymer and a dye forming coupler.

It would therefore be desirable to provide novel condensation polymeric couplers in which the polymer backbone does not form a permanent part of the image dye derived from the coupler moiety upon reaction with an oxidized color developing agent

SUMMARY OF THE INVENTION

In one aspect our invention relates to a photographic element comprising a support, a silver halide emulsion layer and a polymeric dye forming coupler wherein the coupler is a polyester condensation polymer having a pendant coupler moiety in which the coupler is joined to the polymer backbone via its coupling position. These polyester couplers have good dispersability in photographic coating compositions.

The polyester condensation polymer comprises repeating units of copolymerized diacid derived monomers and diol derived monomers. The coupler moiety can be joined to either or both monomers.

DETAILED DESCRIPTION OF THE INVENTION

The polyester couplers of the invention can be represented by the following structures:

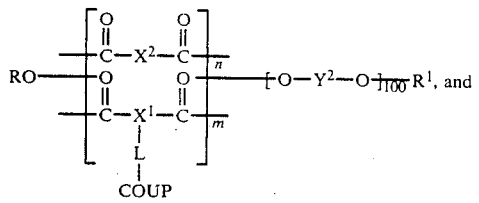

(I)

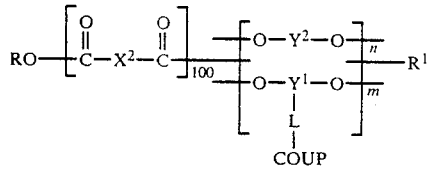

(II)

wherein

R and $R^1$ represent hydrogen, alkyl or aryl;

$X^1$ and $X^2$ each represents alkylene, arylene, or cycloalkylene;

$Y^1$ and $Y^2$ each represents alkylene, arylene, or cycloalkylene;

m is 15 through 100 mole %; and m+n=100 mole %.

COUP represents a dye forming coupler moiety; and

L represents a linking group joined to the coupling position of the coupler moiety.

Alkyl groups represented by R and $R^1$ typically have 1–4 carbon atoms, such as methyl, ethyl, propyl, and butyl. Aryl groups represented by R and $R^1$ typically have 6–12 carbon atoms and include groups like phenyl, tolyl, naphthyl, etc. The alkylene and cycloalkylene groups represented by $X^1$, and $X^2$, typically have 1 to 10 carbon atoms and the alkylene and cycloalkylene groups represented by $Y^1$ and $Y^2$ typically have 2 to 10 carbon atoms. These include groups like methylene, ethylene, propylene, cyclohexylene, and decylene and the like. The arylene groups represented by $X^1$, $X^2$, $Y^1$, and $Y^2$ typically have 6 to 12 carbon atoms and include groups like p- and m-phenylene, p- and m-biphenylene, p- and m- xylylene, and the like.

The alkylene groups represented by $X^1$ and $Y^1$ include alkylene groups interrupted with hetero atoms such a nitrogen, sulfur and oxygen. Thus alkylene includes

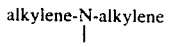

in which the unsatisfied bond of the nitrogen atom represents the attachment to the linking group.

Linking groups represented by L include any organic group that is capable of linking the coupler moiety COUP at its coupling position to the polymer backbone.

Representative linking groups are shown below in which the vertical bond is to the polymer backbone and the horizontal bond is to the coupler moiety:

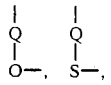

wherein Q represents alkylene, arylene, or a divalent heterocyclic group.

Polymers of this invention, being condensation polymers, permit more precise control of the size of the polymer. Having smaller polymers has the advantages of a polymeric coupler, yet permits shorter polymer backbones and hence better availability of a sterically unhindered coupling moiety for reaction with oxidized color developing agent. Similarly, having a built in spacing group as a result of the repeating condensation units of limited length will enhance activity with a resulting increase in image contrast. In addition, the joining of the coupling moiety to the polymer backbone through its coupling position permits detachment of the coupler during the color development cycle to produce non polymeric image dyes. Thus, the hue of the image dye can be readily modified or controlled without regard to the nature of the polymeric backbone.

Any polyester condensation polymer to which a coupler moiety can be joined by techniques known in the art would be suitable for the present invention.

Preferred polyesters comprise 3–15 repeating polyester units. Such polymers can have a mean molecular weight in the range 1,000 to 10,000. Mean molecular weight is determined by the technique described in Chapter II of *The Elements of Polymer Science and Engineering* by A. Rudin, published by Academic press, 1982.

Preferred polyester couplers of this invention are formed by a condensation reaction between a di-acid chloride and a dihydroxy compound. The coupler moiety can be linked to either the acid moiety or the hydroxy moiety, or both, and it can be joined to either of these two moieties prior to their condensation, or it can be joined to a reactive site which survives condensation.

Especially preferred polyesters according to formulae (I) and (II) include those where $X^1$ and $X^2$ are derived from an aliphatic dicarboxylic acid; and $Y^1$ and $Y^2$ are derived from an aliphatic diol.

Useful diols include aliphatic diols like ethylene glycol, diethylene glycol, triethylene glycol, diethanol amine, 1,2-propanediol, 1,3-propanediol, 1,3-butanediol, 1,4-butanediol, 1,7-heptanediol, 1,8-octanediol, 1,9-nonanediol, 1,10-decanediol, neopentyl glycol, 2,2,4-trimethyl-1,6-hexanediol, and 4-oxa-2,6-heptanediol, as well as cyclic diols such as 1,4-cyclohexanediol, 1,4-cyclohexanedimethanol, 1,4-cyclohexanediethanol, 1,4-bis(2-hydroxyethoxy)-cyclohexane, 1,4-benzenedimethanol, and 1,4-benzenediethanol.

Useful dicarboxylic acids include succinic acid, adipic acid, glutaric acid, malonic acid, suberic acid, sebacic acid, azelaic acid, phthalic acid, isophthalic acid, 1,3-phenyldicarboxylic acid, 1,4-phenyldecarboxylic acid, terephthalic acid, and 1,4-cyclohexane dicarboxylic acid.

The coupler moiety in the polymeric couplers of the invention includes any organic group that is capable of forming a dye upon reaction with an oxidized color developing agent.

Representative cyan dye forming couplers from which the coupler moiety can be derived, are described in U.S. Pat. Nos. 2,367,531; 2,423,730; 2,474,293; 2,772,162; 2,895,826; 3,002,836; and 3,041,236.

Representative magenta dye forming couplers from which the coupler moiety can be derived, are described in U.S. Pat. Nos. 2,343,703; 2,369,489; 2,600,788; 2,908,573; 3,062,653; 3,152,896; and 3,519,429.

Representative yellow dye forming couplers from which the coupler moiety can be derived, are described in U.S. Pat. Nos. 2,875,057; 2,407,210; 2,665,506; 2,298,443; 3,048,194; and 3,447,928.

Exemplary coupler monomers for couplers in accordance with the present invention have the structures:

TABLE I

1.

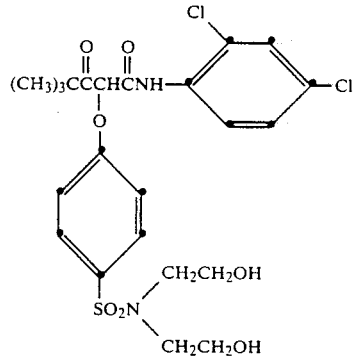

TABLE I-continued
2.
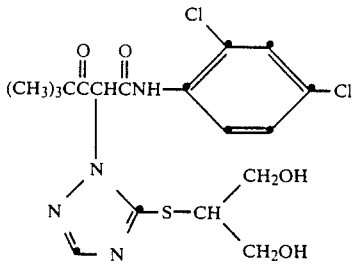
3.
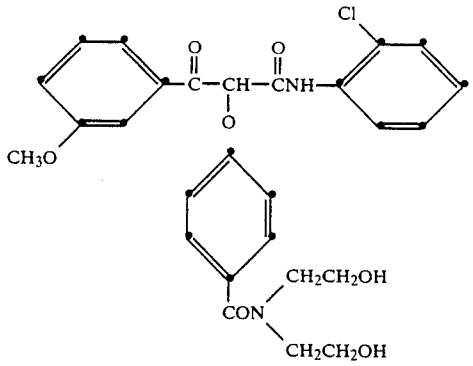
4.
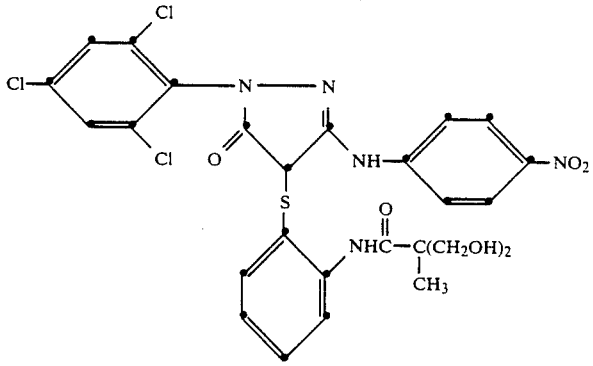
5.
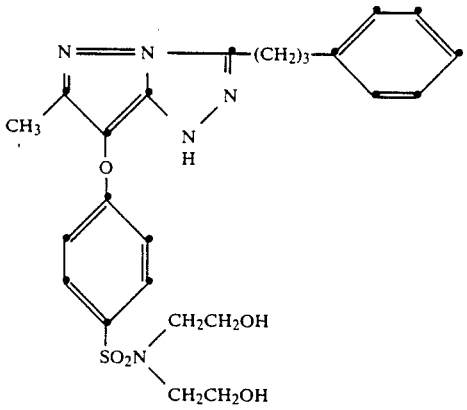

TABLE I-continued
6.
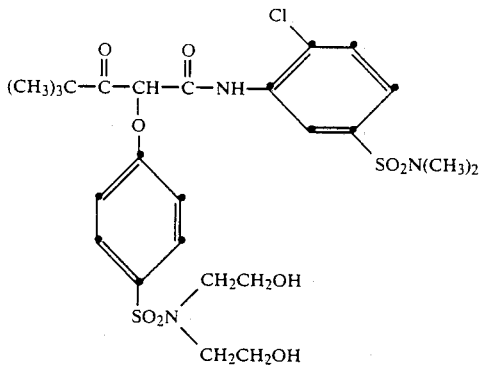
7.
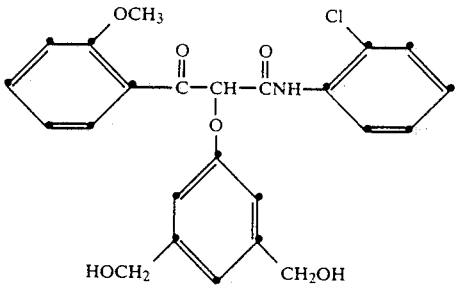
8.
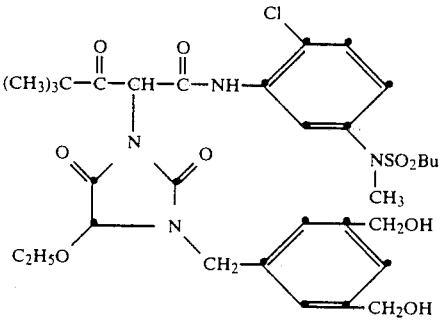
9.
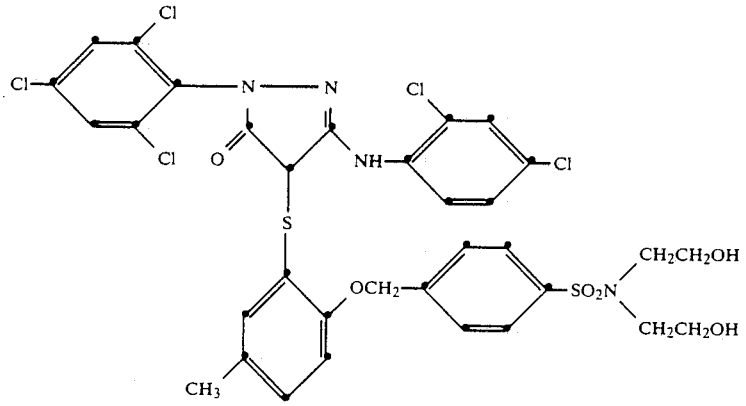

TABLE I-continued
10.
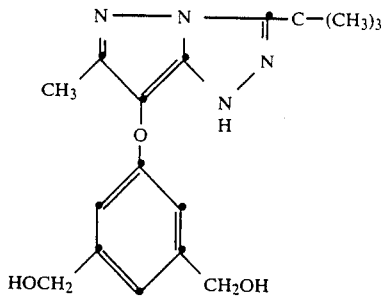
11.
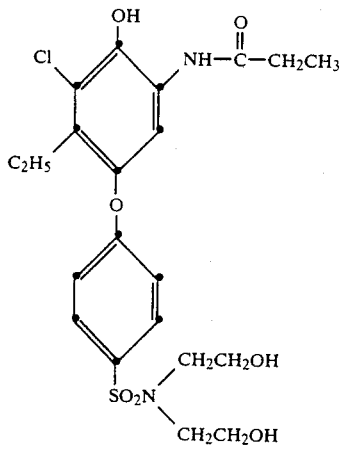
12.
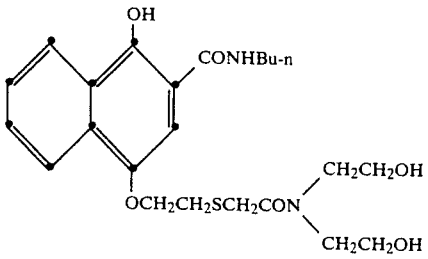
13.
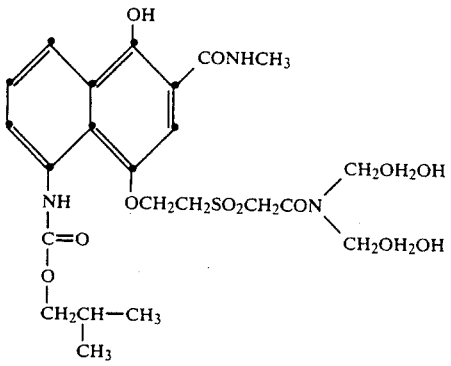

TABLE I-continued
14.
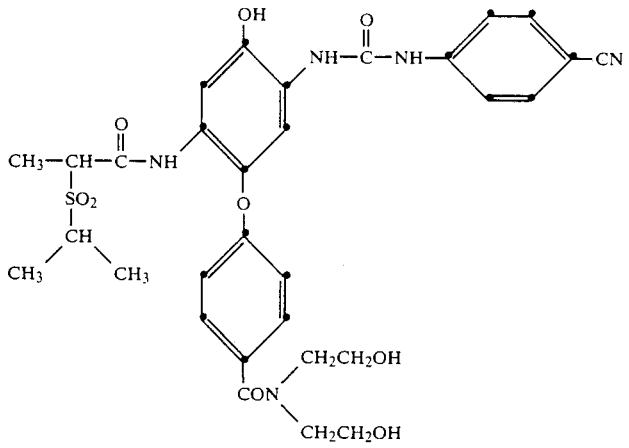
15.
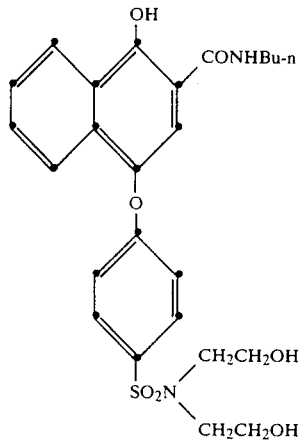
16.
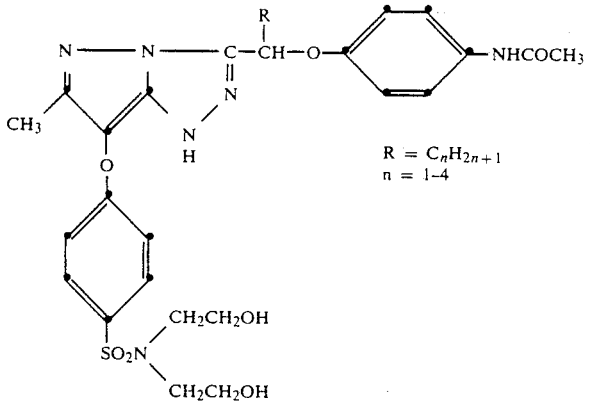

TABLE I-continued

17.

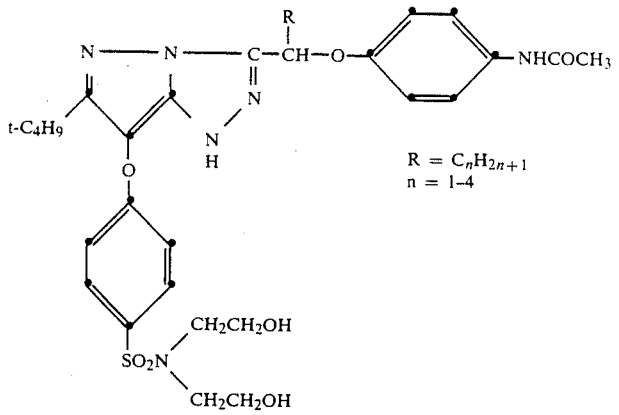

18.

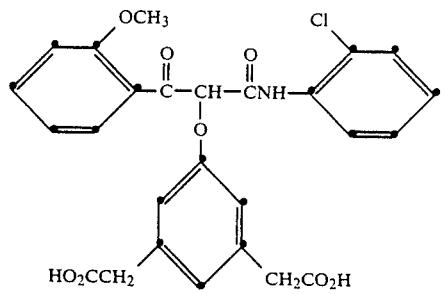

The polymeric couplers of this invention can be used in the ways and for the purposes that polymeric couplers are used in the photographic art. They may be used in any concentration which is effective for the intended purpose. Generally, good results are obtained using concentrations ranging from $10^{-4}$ to 0.5 mole of polymeric coupler per mole of silver in the photographic element.

A photographic element in which the polymeric couplers of this invention is incorporated can be a simple element comprising a support and a single silver halide emulsion layer or it can be multilayer, multicolor element. The polymeric couplers of this invention can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, other photographic coupler compounds, such as non polymeric color forming couplers, colored masking couplers, competing couplers, DIR couplers, DIAR-couplers, and the like. These other photographic coupler compounds can form dyes of the same or different color and hue as the polymeric coupler compounds of this invention. Additionally, the silver halide emulsion layer can contain addenda conventionally contained in such layers.

A typical photographic element of the invention comprises a support having thereon a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith a leat one magenta dye-forming coupler, and a yellow dye image-forming unit comprising at least one blue-sensitive silver halide emulsion layer having associated therewith at least one yellow dye-forming coupler, at least one of the couplers in the element being a polymeric coupler as defined herein. The element can contain additional layers, such as filter layers, interlayers, overcoat layers, subbing layers, and the like.

In the following discussion of suitable materials for use in the emulsions and elements of this invention, reference will be made to Research Disclosure, December 1987, Item 17643, published by Industrial Opportunities Ltd., Homewell Havant, Hampshire, p09 1EF, UK, the disclosures of which are incorporated herein by reference. This publication will be identified hereafter by the term "Research Disclosure".

The photographic elements of this invention or individual layers thereof can be chemically sensitized, as described in Section III; contain brighteners, as described in Section V; antifoggants and stabilizers, as described in Section VI; antistain agents and image dye stabilizers, as disclosed in Section VII, paragraphs I and J; light absorbing and scattering materials, as described in Section VIII; hardeners, as described in Section XI; plasticizers and lubricants, as described in Section XII; antistain agents, as described in Section XIII; matting agents, as described in Section XVI; and development modifiers, as described in Section XXI of the Research Disclosure.

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Development is followed by the conventional steps of bleaching, fixing, or bleach fixing, to remove silver and silver halide, washing and drying.

The polymeric couplers prepared by the method according to this invention are useful in combination with other couplers, such as monomeric and/or polymeric couplers known in the photographic art, such as those describes in Research Disclosure Section VII, paragraphs D, E, F, and G and the publications cited therein.

These couplers can be incorporated in the elements and emulsions as described in Research Disclosure Section VII, paragraph C, and the publications cited therein.

The polymeric couplers according to this invention can be prepared by procedures generally known in the organic compound synthesis art. It is preferred that the coupler moiety be joined to the monomer prior to condensation. However, if an appropriate reactive site is present on the polymer backbone after condensation, it is possible to join the coupler moiety at that site. In some instances, this may be a preferred synthesis technique. The procedure described below for the synthesis of a representative polymeric coupler is illustrative of the process used for preparing the condensation polyester couplers of this invention.

Preparation of Coupler 1

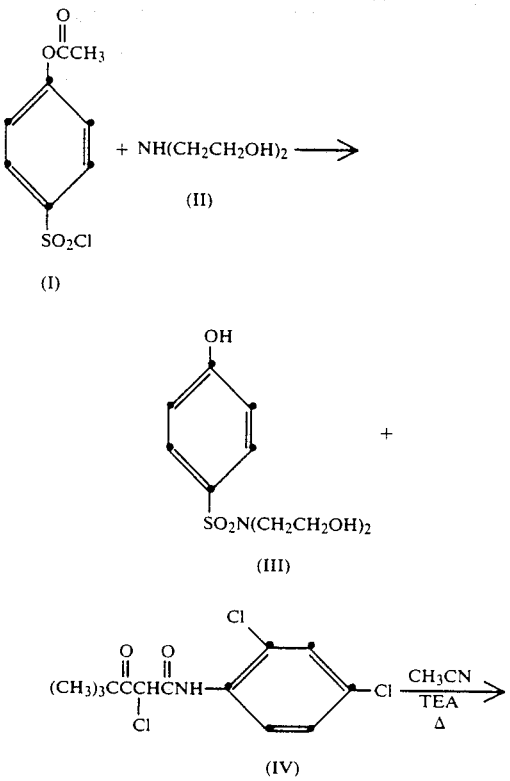

-continued

Preparation of Coupler 1

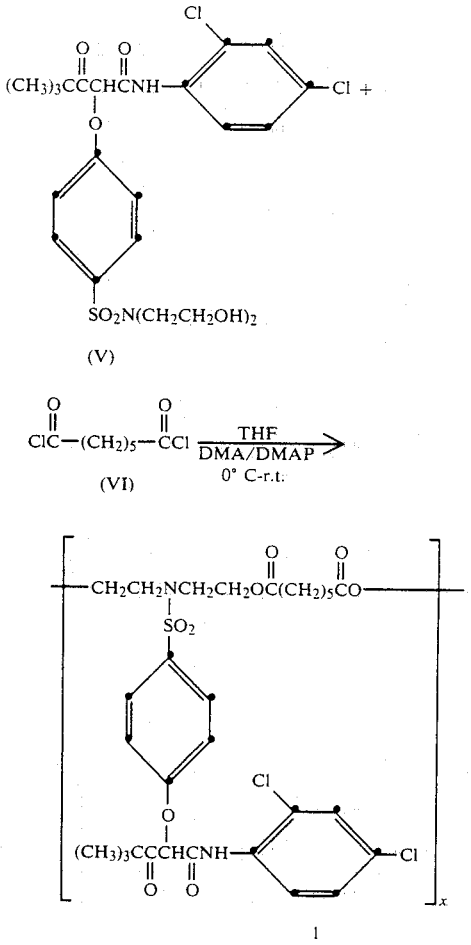

4-Hydroxy-N,N-bis(2-hydroxyethyl)benzene sulfonamide (III)

A solution of 46.9 g (0.20 mole) of 4-acetoxybenzenesulfonyl chloride (I) in 400 ml dichloromethane contained in a 500-ml round-buttomed flask was dried over magnesium sulfate, then filtered and placed in a 3-liter, 3-necked, round-buttomed flask equipped with a stirrer, an additional funnel, a condenser and a thermometer. After subsequent cooling to 5° C., 142.2 g (0.70 mole) of diethanolamine (II) were added slowly with stirring. The reaction mixture was allowed to reach room temperature and was then stirred for 2 hours, followed by the addition of a mixture of 30 ml sodium hydroxide (50%) and 20 ml water. The resulting two phase mixture was stirred at room temperature for an additional two hours. The aqueous layer was extracted with two 150-ml portions of dichloromethane, and the aqueous phase was cooled in an ice bath and acidified with concentrated HCl to a pH of 2.0. Sodium hydroxide was added to saturate the aqueous phase, which was then extracted with ten 300-ml portions of ethylacetate, followed by roto-evaporation of the combined ethyl acetate extracts to dryness. A white solid (III) was collected, washed with heptane and dried under vacuum. The yield was 24.7 g (42.3%).

Coupler monomer (V)

A mixture consisting of 67.75 g (0.20 mole) of chloro substituted yellow coupler (IV), 500 ml acetonitrile and 42.5 g (0.42 mole) triethylamine (TEA) was placed in a 1-liter, 3-necked, round-buttomed flask equipped with a mechanical stirrer, a nitrogen inlet and a reflux condenser. After the addition of a solution of 55.0 g (0.215 mole) of intermediate (III) in 100 ml acetonitrile, the reaction mixture was refluxed for three hours, cooled, filtered, and poured into 2,500 ml of an ice/water mixture containing 75 ml of concentrated hydrochloric acid. After decanting the aqueous phase, the oily product was dissolved in dichloromethane. The organic phase was washed with water, dried, filtered and concentrated under reduced pressure to give a gum. The product was purified by chromatography on silica gel to afford an oil which solidified upon cooling and seeding. The thus obtained solid was further purified by slurrying in diethyl ether.

Yield: 47 g (43%)

Polymeric coupler 1

A mixture consisting of 6.84 g (0.0125 mole) of the coupler (V) and 85 ml dry tetrahydrofuran (THF) was dissolved in a 250-ml, 3-necked, round-buttomed flask equipped with an air-driven stirrer, a nitrogen inlet, a condenser, and an additional funnel, followed by the addition of 3.325 g (0.0275 mole) of N,N-dimethylaniline (DMA) and 1.22 g (0.010 mole) of 4-dimethylaminopyridine (DMAP). To the resulting solution, cooled in an ice bath, was added dropwise a solution of 2.463 g (0.0125 mole) of pimeloyl chloride (VI) in 25 ml of dry THF. The reaction mixture was allowed to attain room temperature, stirred for 16 hours, then poured into an ice/water mixture containing 10 ml concentrated hydrochloric acid. The white solid was collected, washed with water and dried under vacuum.

Yield: 8.12 g (96%)

The following examples are included for a further understanding of the invention:

EXAMPLE 1

Three photographic elements having the schematic structure shown below were prepared. The coverages are shown in parentheses.

| |
|---|
| Gelatin (1.08 g/m$^2$) |
| Bis(vinylsulfonylmethyl)ether (0.09 g/m$^2$) |
| Gelatin (3.77 g/m$^2$) |
| Coupler see below (1.5 × 10$^{-3}$ mole/m$^2$) |
| Polydispersed sulfur and gold sensitized silver bromoiodide (6.5% I) gelatino emulsion (0.90 g Ag/m$^2$) |
| Polyethylene terephthalate film support |

The photographic elements were imagewise exposed through a graduated-density test object and then processed at 40° C. as follows:

| Processing Solution | Time |
|---|---|
| Developer | 2 min. |
| Stop | 2 min. |
| Wash | 2 min. |
| Bleach | 4 min. |
| Wash | 2 min. |
| Fix | 2 min. |

-continued

| Processing Solution | Time |
|---|---|
| Wash | 2 min. |

The processing solutions had the following compositions:

| | |
|---|---|
| Developer | |
| Water | 900.0 mL |
| Potassium sulfite | 2.00 g |
| 4-amino-3-methyl-N-ethyl-N-β-hydroxyethylaniline sulfate | 3.55 g |
| Potassium carbonate (anhydrous) | 30.00 g |
| Potassium bromide | 1.25 g |
| Potassium iodide | 0.6 mg |
| Water to make | 1.0 L |
| pH at 24° C. | 10.0 |
| Stop leave in Bath | |
| Glacial acetic acid | 30.0 mL |
| Water to make | 1.0 L |
| Bleach | |
| Water | 600.0 mL |
| Ammonium Bromide | 150.00 g |
| Ammonium ferric EDTA solution (1.56 M) | 175.00 mL |
| Glacial Acetic Acid | 9.50 mL |
| Sodium Nitrate | 35.00 g |
| Water to make | 1.00 L |
| Fix | |
| Water | 750.00 mL |
| Sodium sulfite | 6.00 g |
| Sodium metabisulfite | 1.50 g |
| Sodium thiosulfate pentahydrate | 250.00 g |
| Sodium hydroxide (50% solution) | 0.30 mL |
| Water to make | 1.00 L |

The coupler employed had the following structure:

Invention coupler 1

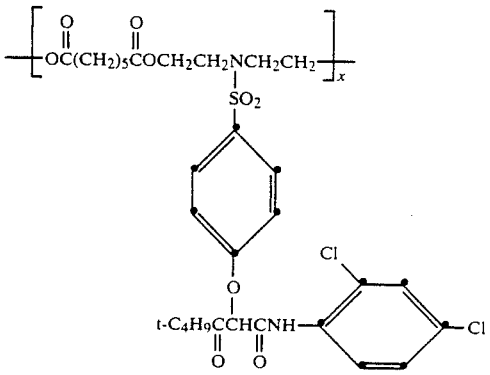

Comparison couplers

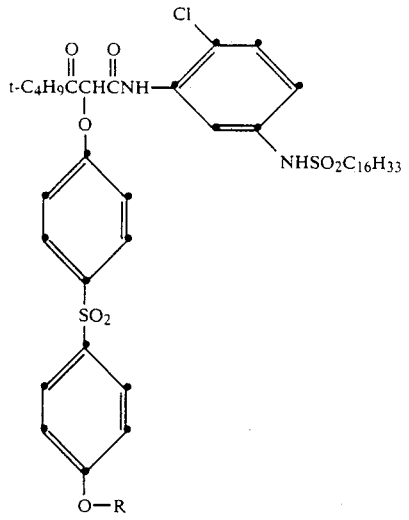

TABLE 1

| | Dmax | Gamma |
|---|---|---|
| Element 1 (Invention Coupler 1) | 2.68 | 1.00 |
| Element 2 (Comparison Coupler A) | 2.92 | 0.93 |
| Element 3 (Comparison Coupler B) | 2.66 | 0.73 |

A: R = H
B:

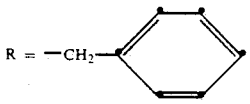

The results shown in Table 1 indicate that, while the sensitometric properties of the element containing the polymeric coupler according this invention generally are as good as those of elements containing monomeric dye forming couplers of the state of the art, the polymeric coupler yielded a dye image of higher contrast.

The invention has been described in detail with particular reference to preferred embodiments thereof, but it will be understood that variations and modifications can be effected within the scope of the invention.

What is claimed is:

1. A photographic element comprising
a support,
a silver halide emulsion layer, and
a polymeric dye-forming coupler
wherein the polymeric dye-forming coupler is a polyester condensation polymer having a pendant coupler moiety in which the coupler is joined to the polymer backbone via its coupling position, and is represented by one of the following structures:

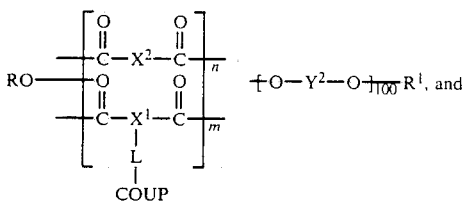

(I)

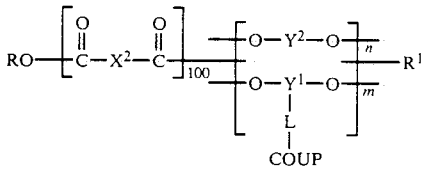

(II)

wherein
R and $R^1$ represent hydrogen, alkyl or aryl;
$X^1$ and $Y^1$ each represents alkylene, arylene, cycloalkylene or -alkylene-N-alkylene-;
|

$X^2$ and $Y^2$ each represents alkylene, arylene, or cycloalkylene;
m is 15 through 100 mole %; and
M+n=100 mole %.
COUP represents a dye forming coupler moiety; and
L represents a linking group joined to the coupling position of the coupler moiety.

2. A photographic element of claim 1 wherein the coupler moiety is a cyan dye-forming coupler moiety.

3. A photographic element of claim 1 wherein the coupler moiety is a magenta dye-forming coupler moiety.

4. A photographic element of claim 1 wherein the coupler moiety is a yellow dye-forming coupler moiety.

5. A photographic element of claim 1 wherein the coupler moiety is derived from a coupler monomer having one of the structures:

1.

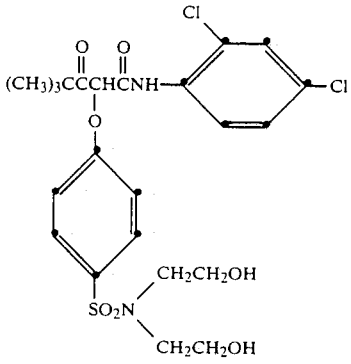

-continued
2.
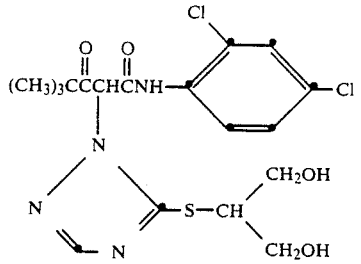
3.
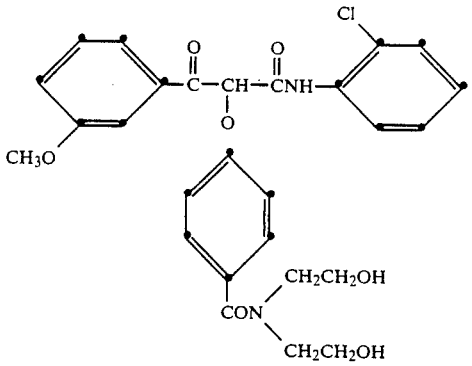
4.
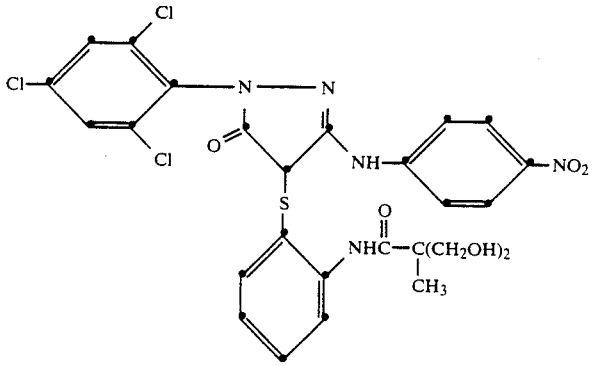
5.
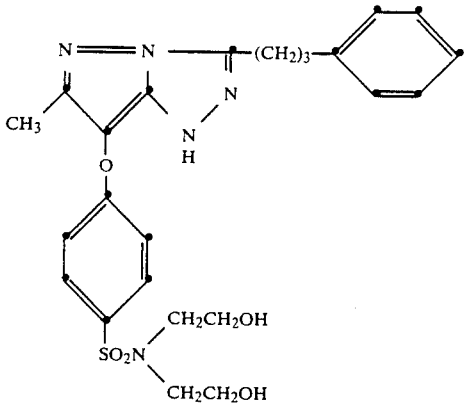

-continued
6.
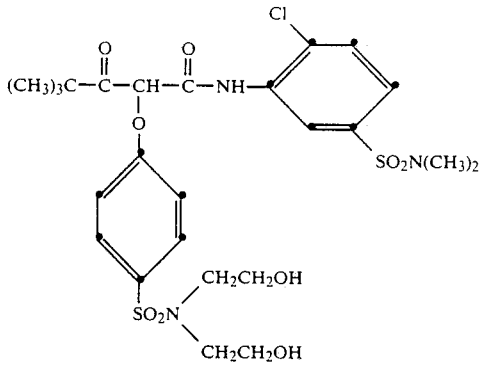
7.
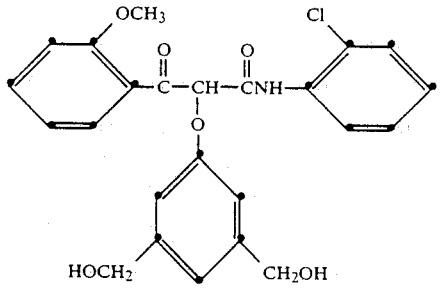
8.
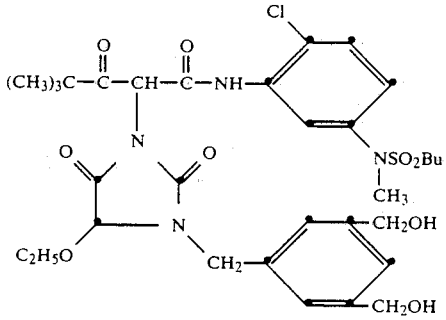
9.
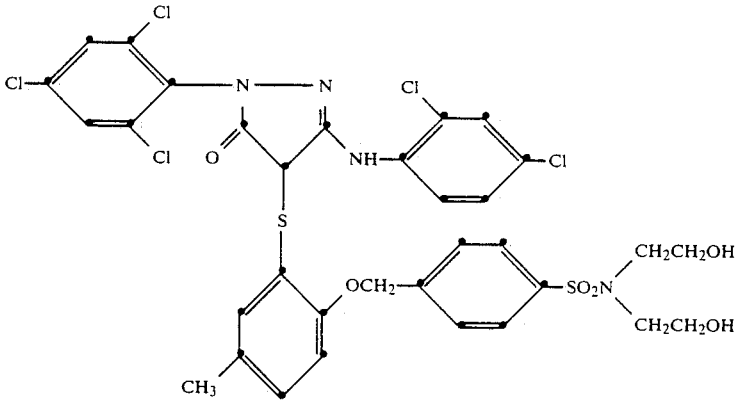

-continued
10.
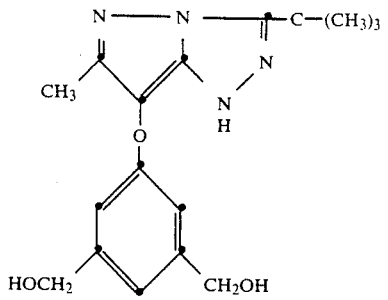
11.
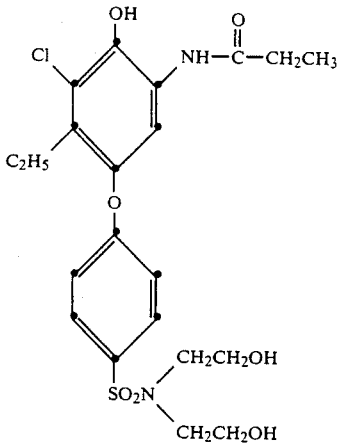
12.
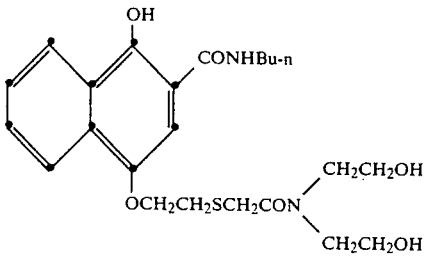
13.
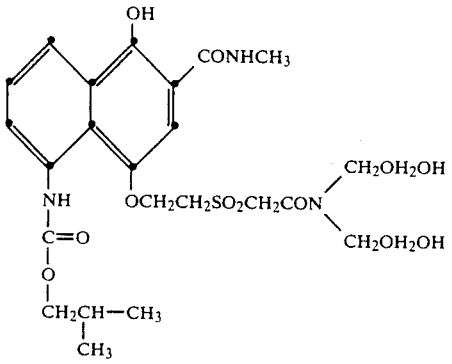

-continued
14.
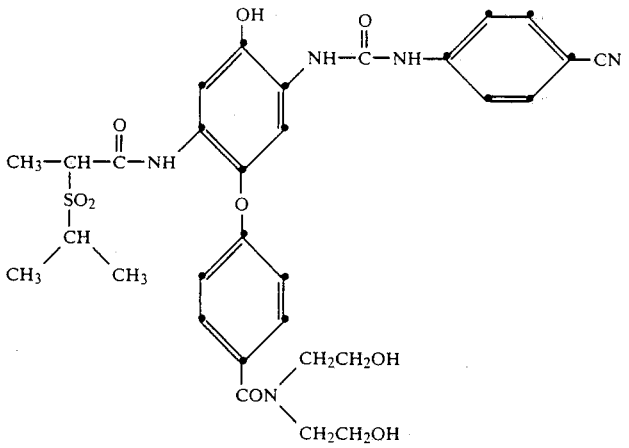
15.
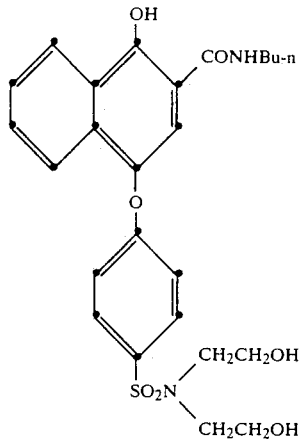
16.
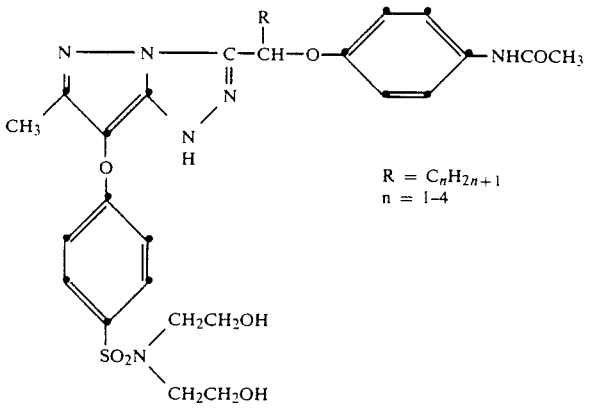

-continued
17.
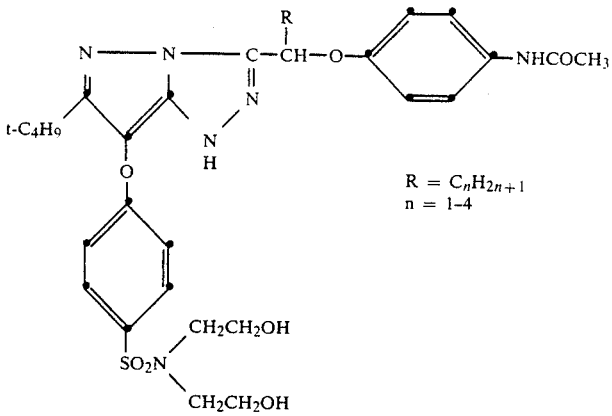
18.
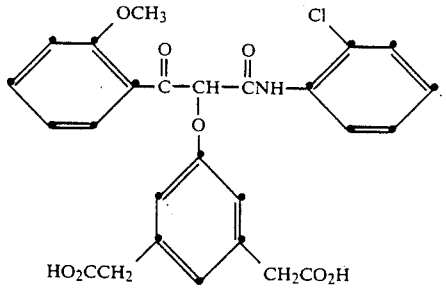
6. A photographic element of claim 1 wherein the coupler comprises repeating units that have the structure:
1
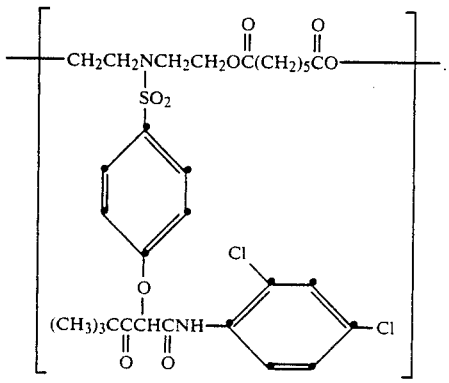
* * * * *